US006911885B2

(12) United States Patent
Kim et al.

(10) Patent No.: US 6,911,885 B2
(45) Date of Patent: Jun. 28, 2005

(54) WINDING FRAME AND DEFLECTION YOKE

(75) Inventors: Gyoung Su Kim, Sungnam-Shi (KR); Young Gil Namgong, Suwon-Shi (KR); Cheong Moon Lee, Sungnam-Shi (KR); Seok Hwan Hwang, Suwon-Shi (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/085,648

(22) Filed: Feb. 27, 2002

(65) Prior Publication Data

US 2003/0122642 A1 Jul. 3, 2003

(30) Foreign Application Priority Data

Dec. 27, 2001 (KR) ..... 2001-86350

(51) Int. Cl.[7] ..... H01F 7/00
(52) U.S. Cl. ..... 335/210; 335/213
(58) Field of Search ..... 335/210–213; 413/440–441; 313/440–441

(56) References Cited

U.S. PATENT DOCUMENTS 5,121,028 A * 6/1992 Milili ..... 313/440
5,138,290 A * 8/1992 Togane et al. ..... 335/210
5,302,927 A * 4/1994 Fourche et al. ..... 335/210
6,621,203 B2 * 9/2003 Nelle et al. ..... 313/440

* cited by examiner

*Primary Examiner*—Lincoln Donovan
(74) *Attorney, Agent, or Firm*—Darby & Darby

(57) ABSTRACT

Disclosed is a deflection yoke to improve screen quality, including a coiling density adjustment groove formed along a vertical direction of a coil by way of increasing the coiling density at an arbitrary portion of the electric field at the internal side of the deflection coil. To this end, a winding frame is provided for winding coil around the deflection yoke, having a curvature of a designated shape at the center, in which the winding frame includes a wire position guide that projects as much as a designated width to a vertical direction of a coil to be wound around an arbitrary portion of the internal electric field for increasing a coiling density.

4 Claims, 6 Drawing Sheets

WINDING FRAME AND DEFLECTION YOKE

BACKGROUND OF THE INVENTION

1. Field of the Invention

The present invention relates to a deflection yoke. In particular, the present invention relates to the formation of a groove for adjusting the coiling density (or the quantity of the coil to be wound on a deflection coil) to a vertical direction at an arbitrary portion of an electric field on the internal side of the deflection coil in order to improve the coiling density of the deflection coil. Further, the present invention relates to the formation of a wire position guide on the inside of the winding frame of a winding machine that winds the deflection coil.

In other words, the present invention primarily aims to improve the characteristics of a deflection yoke in general by improving the constitution of a winding frame necessary for winding a deflection coil of a deflection yoke which consequently improves the properties of the deflection coil manufactured thereby.

2. Description of the Related Art

FIG. 1 is a schematic cross-sectional view showing a construction of a general deflection yoke according to a related art. As shown in the drawing, the deflection yoke deflects the electron beams emitted from a RGB electron gun 103 mounted on the neck portion of a cathode-ray tube 102 in all directions, i.e., left/right and up/down directions, and makes the deflected electron beam hit a precise position on a fluorescent face of the cathode-ray tube.

In general, a deflection yoke 101 includes a conical coil separator 113 mounted with a front cover 111 that bonds with the cathode-ray tube 102 and a rear cover 112 that bonds with the neck portion on the opposite end, a ferrite core 114 forming a magnetic field on the exterior of the coil separator, and a deflection coil forming a magnetic field together with the ferrite core. The deflection coil is divided into a horizontal deflection coil 113*a* for adjusting the magnetic field in the horizontal direction, and a vertical deflection coil 113*b* for adjusting the magnetic field in the vertical direction.

The winding machine for winding the deflection coil is composed of two frames that operate in gear with each other as shown in FIG. 2.

The so constructed winding frame is divided into A-type frame 201 for winding a D-curve on the inside of the deflection coil, and B-type frame 202 for winding an F-curve on the exterior of the deflection coil.

The A-type winding frame 201 is composed of a winding face 203 and a guide face 204 disposed on the both sides of the winding face.

The winding face 203 has a designated-shaped curved surface and inclination to wind the D-curve on the inside of the deflection coil of the deflection yoke. Thus, if the coil is wound, a deflection coil having the same shape as the winding face 203 is produced.

In addition, the guide face 204 formed on the both sides of the winding face 203 has a curved surface with a designated curvature, and is found along the direction of winding the coil. The guide face functions as a guide for entry of the coil by providing a back tension in an opposite direction of winding the coil.

FIG. 3 is a perspective view of a winding face of a general A-type winding frame according to a related art. The A-type frame is operated through a guide pin hole 206 that projects on the winding face 203.

Moreover, the B-type frame (refer to 202 in FIG. 2) is in gear with the A-type frame. As depicted in the drawing, unlike the A-type frame, the central portion of the B-type frame has a concave curved surface, called a winding face of the B-type frame.

The procedure of winding coil performed by the winding frames is now briefly explained. Once the winding frames are operated, the frames are rotated, and the coil wound around a bobbin (not shown) is uncoiled and instead, it flows in along the guide face 204 of the A-type winding frame 201 to be wound around the winding face 203.

At the time, the guide face 204 provides a back tension in an opposite direction of the wound coil, consequently guiding the entry of the coil.

In short, the manufacturing process of a deflection coil of a deflection yoke using a winding machine composed of a traditional winding frame can be summarized as follows.

First of all, the winding task is performed on the winding face of the A-type and the B-type winding frames, where the A-type frame moves to the right and left while the B-type frame moves up and down. Also, a guide pin 205 undergoes reciprocation on the inside of the guide pin hole 206, through which the coil takes shape.

Afterwards, causing electricity to flow for the fusion (welding) finishes up the coil molding, and the coil is cooled down to harden the final shape of the coil as the way it is molded. Once the coil is molded, it goes through a bleed step.

In a so manufactured deflection coil, the coil is molded like the layered shape that is formed during the winding task between the D-curve on the inside and the F-curve on the outside. At this time, the coiling density varies depending on a cross section of the coil wound around the sectional area of the winding frame.

FIG. 4 is a perspective view showing a part of the deflection coil that went through the manufacturing process described above.

Unfortunately however, when a general deflection coil is used for a deflection yoke, a phenomenon called mis-convergence occurs at the corner of the monitor screen, so the screen quality in general is deteriorated. In many cases, PQH(−) characters deteriorate said mis-convergence as well.

FIG. 5 illustrates a poorly converged PQH(−). As shown in the drawing, R and B are not in accord with G (wherein, R is represented by a solid line, and B is represented by a dotted line).

The PQH is sometimes called CH. Apparently shown in the following mathematical equation I, as the PLM gets larger, the mis-convergence occurs at the corner of the screen.

$$PLM=PQH-(XH+YH). \qquad \text{(Mathematical Equation I)}$$

wherein, XH and YH are horizontal errors at the x-axis and y-axis, or the corner, on the basis of G, given that R, G, and B are chrominance components manifested on the screen as shown in FIG. 6.

Moreover, a phenomenon called S3V (+) shown in FIG. 7 is also caused by the coiling density. Similar to before, FIG. 7 illustrates the case in which R and B are not in accord with G (here again, R is represented by a solid line, and B is represented by a dotted line).

Many attempts have been made to solve the problems with the traditional technique by altering a coiling number around the deflection yoke or through a local welding. In result, although the characteristic of a specific part was locally improved, the entire coiling density was changed thereby, which consequently failed to enhance the screen quality.

SUMMARY OF THE INVENTION

It is, therefore, an object of the present invention to provide a winding frame and a deflection yoke for improving the constitution of a winding face of a winding frame by changing the coiling density on the inside of the deflection yoke by way of resolving a problem with mis-convergence.

In other words, the present invention is directed to enhancing overall characteristics of a deflection yoke by improving a deflection coil that is manufactured by using a winding frame with an improved constitution for winding a deflection coil of a deflection yoke.

To achieve the above object, there is provided a winding frame, which includes a winding face having a curvature of a designated-shape at the center, having mounted thereon a wire position guide that projects as much as a designated width in a vertical direction of a coil to be wound around an arbitrary portion of the internal electric field for increasing coiling density; a guide face for guiding an entry of the coil, being disposed at both sides of the winding face with a curved surface and an inclination of a designated shape, and having mounted therein an internal guide pin for shaping a coil to be wounded around the winding face; and a base for supporting the winding face and the guide face, being fixed onto the guide face vertically.

Another preferred embodiment of the present invention provides a deflection yoke, which includes a conical coil separator having mounted thereon a front cover that bonds with a cathode-ray tube and a rear cover that bonds with the neck portion on the opposite end, a ferrite core for forming a magnetic filed on the exterior of the coil separator, and a deflection coil for forming a magnetic field together with the ferrite core, in which a coiling density adjustment groove is formed in a vertical direction of the coil in order to increase the coiling density at an arbitrary portion of an electric field inside of the deflection coil.

Preferably, the wire position guide of the winding frame according to the present invention is disposed at approximately ½ of a longitudinal direction of the electric field.

Furthermore, the coil density adjustment groove of the deflection coil of the deflection yoke manufactured according to the present invention is also disposed at approximately ½ of the longitudinal direction of the electric field.

The deflection coil can be either a horizontal deflection coil or a vertical deflection coil.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

Figure 1:
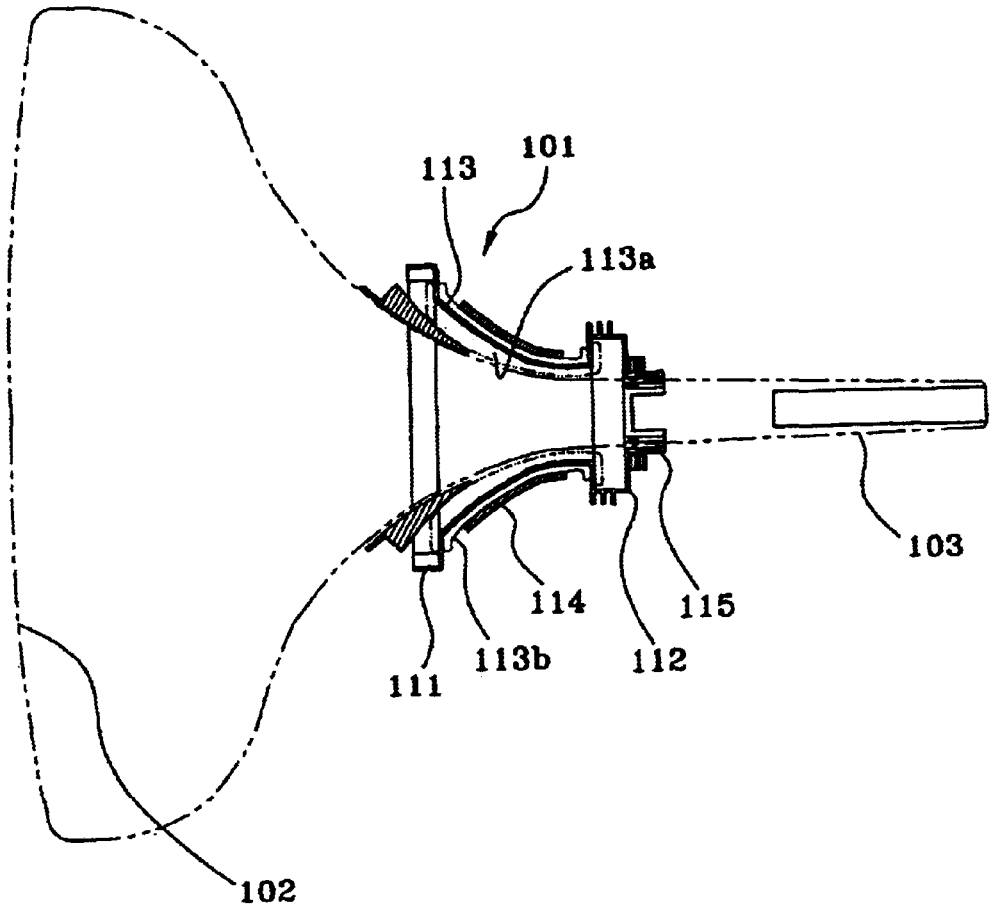
PRIOR ART FIG. 1
FIG. 1 is a cross-sectional view showing a general deflection yoke according to a related art.
Figure 2:
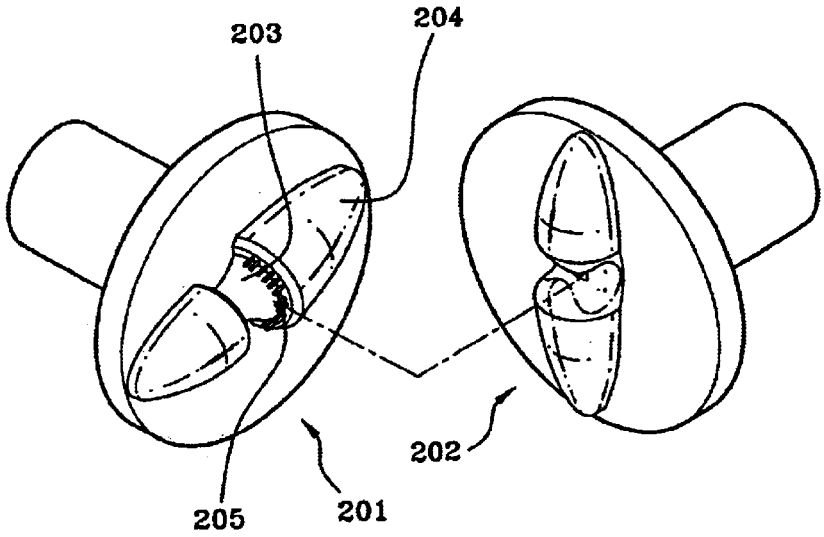
PRIOR ART FIG. 2
FIG. 2 is a perspective view showing a general winding frame according to a related art.
Figure 3:
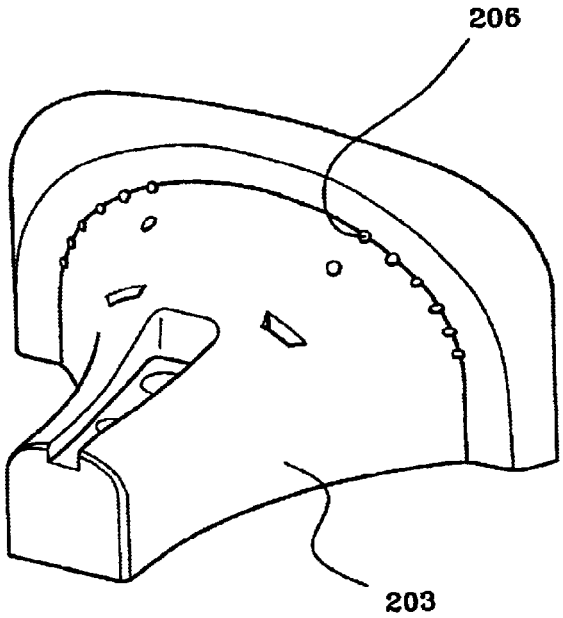
PRIOR ART FIG. 3
FIG. 3 is a perspective view showing a winding face of a general A-type winding frame according to a related art.

A preferred embodiment of the present invention will now be described with reference to the accompanying drawings. In the following description, the same drawing reference numerals are used for the same elements even in different drawings. The matters defined in the description such as a detailed construction and elements of a circuit are simply ones provided to assist in a comprehensive understanding of the invention. Thus, it is apparent that the present invention can be carried out without those defined matters. Also, well-known functions or constructions are not described in detail since they would obscure the invention in unnecessary detail.

Figure 8:
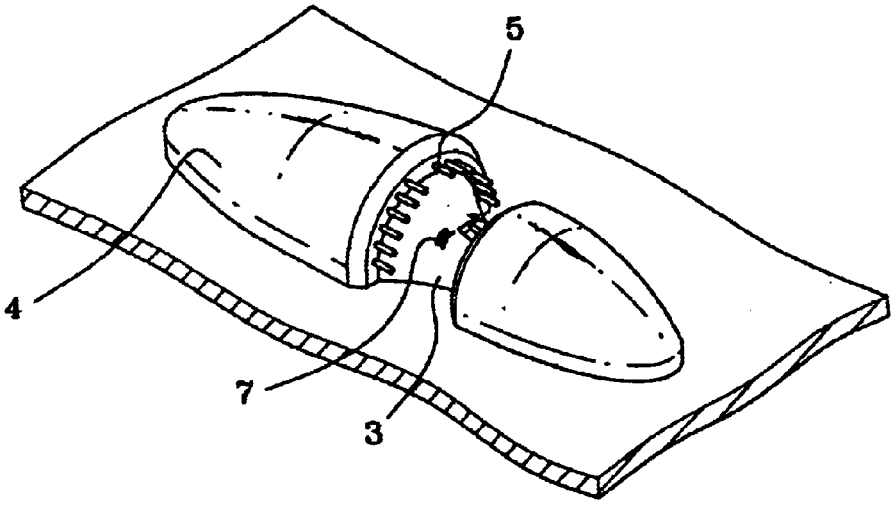
FIG. 8 is a perspective view showing an A-type winding frame according to the present invention.

FIG. 8 is a perspective view illustrating an A-type winding frame according to a preferred embodiment of the present invention. As depicted in the drawing, there exists a winding face 3 with a curvature of a designated shape at the center of the winding frame. And, mounted on the winding face 3 is a wire position guide 7, which projects as much as a designated width in a vertical direction of the coil to be wound around an arbitrary portion of the inside of the electric field, in order to increase the coiling density of the coil to be wounded.

In addition, a guide face 4 having a curved surface and an inclination of a designated shape is formed on both sides of the winding face 3. On the other hand, there is a guide pin 5 mounted on the inside of the guide face, having a function of guiding an entry of the coil for the purpose of shaping the coil to be wounded around the winding face 3.

Figure 9:
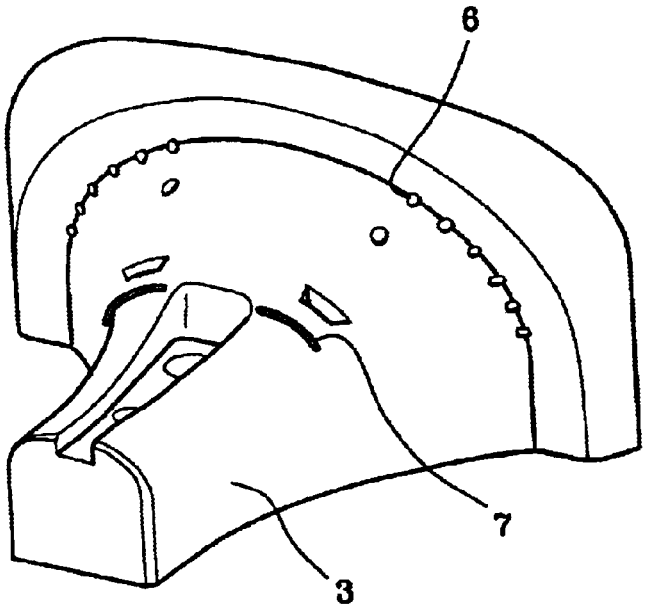
FIG. 9 is a perspective view showing a winding face of the A-type winding frame according to the present invention.

FIG. 9 is a perspective view showing an important part of the A-type frame according to the present invention. Preferably, the wire position guide 7 projects approximately 1 to 3mm. However, this is adjustable at any time depending on the intensity of the magnetic field.

Figure 4:
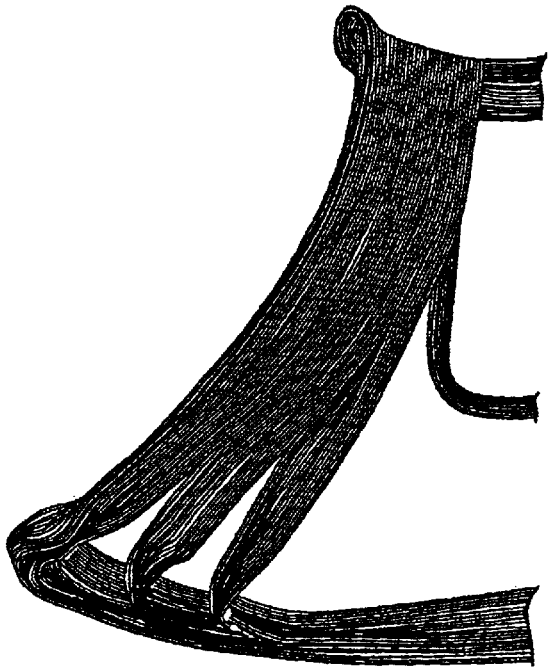
PRIOR ART FIG. 4
FIG. 4 is a perspective view showing a part of a deflection coil according to a related art.
Figure 5:
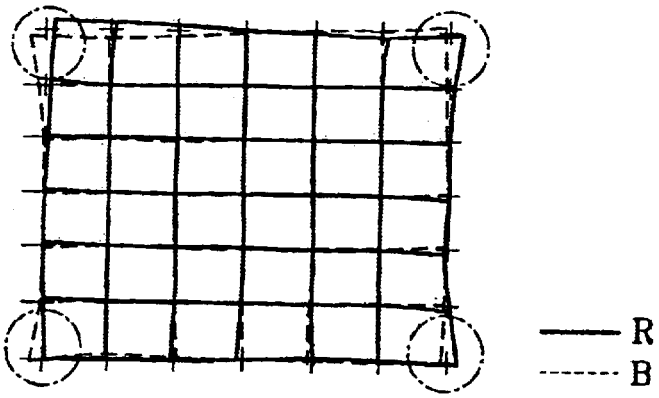
PRIOR ART FIG. 5
FIG. 5 diagrammatically shows a PQH(−) mis-convergence on a screen of a deflection yoke according to a related art.
Figure 6:
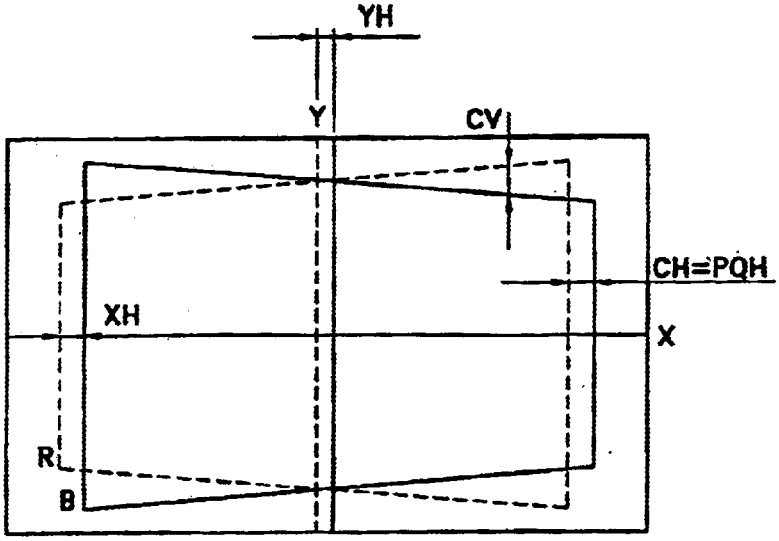
PRIOR ART FIG. 6
FIG. 6 is a conceptual diagram showing XH, YH, CV, and CH on a screen as an example of the mis-convergence.
Figure 7:
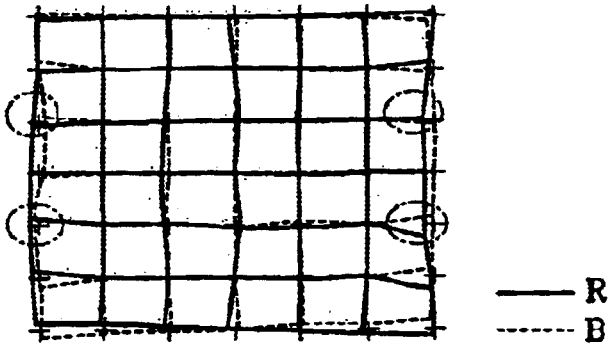
PRIOR ART FIG. 7
FIG. 7 diagrammatically shows a S3V(+) mis-convergence on a screen of a deflection yoke according to a related art.
Figure 10:
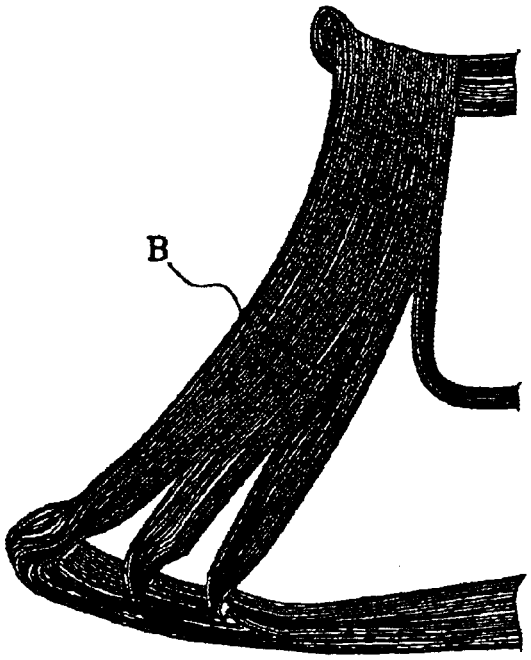
FIG. 10 is a perspective view showing a deflection coil according to the present invention.

FIG. 10 is a perspective view showing a part of a shape of the deflection coil bled from the winding frame for use of the deflection yoke according to the present invention. Being slightly different from the deflection coil in FIG. 4, the deflection coil depicted in FIG. 10 has a thin groove around the central portion of the inside of the coil ("B" portion). This groove is called a coiling density adjustment groove.

Figure 11:
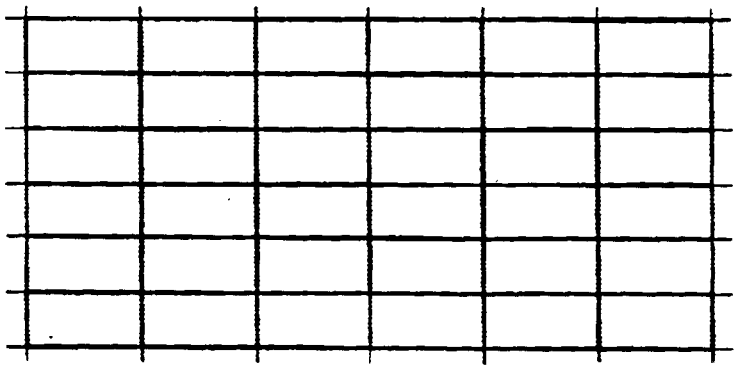
FIG. 11 shows an improved screen by using a deflection yoke according to the present invention.

Thusly constituted coil is then used for assembling a large planar type deflection yoke, enhancing particularly PQH and S3V characteristics out of other convergence characteristics on a screen. FIG. 11 depicts the improved characteristics on the screen.

In conclusion, by improving the constitution of the winding face of the A-type winding frame of the deflection yoke coil winding machine according to the present invention, it is now possible to correct the mis-convergence and to enhance productivity and efficiency thereof.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A deflection yoke, comprising:

a conical-shaped coil separator mounted with a front cover that bonds with a cathode-ray tube and a rear cover that bonds with the neck portion on the opposite side;

a ferrite core for forming a magnetic field on the exterior of the coil separator;

a deflection coil having windings and forming a magnetic field together with the ferrite core; and a coiling density adjustment groove, formed to face away from the cathode ray tube on the exterior of the coil crosswise to the windings, thereby increasing coiling density of an electric field inside the deflection coil and underlying the groove.

2. The deflection yoke according to claim 1, wherein the coiling density adjustment groove is formed at an approximately ½ position of a longitudinal direction of the electric field.

3. The deflection yoke according to claim 1, wherein the deflection coil is a horizontal deflection coil.

4. The deflection yoke according to claim 1, wherein the deflection coil is a vertical deflection coil.

* * * * *